US008370154B2

(12) United States Patent
Dai et al.

(10) Patent No.: US 8,370,154 B2
(45) Date of Patent: Feb. 5, 2013

(54) METHOD AND APPARATUS FOR GENERATING AN EXCITATION SIGNAL FOR BACKGROUND NOISE

(75) Inventors: Jinliang Dai, Shenzhen (CN); Libin Zhang, Shenzhen (CN); Eyal Shlomot, Shenzhen (CN); Lin Wang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 224 days.

(21) Appl. No.: 12/887,066

(22) Filed: Sep. 21, 2010

(65) Prior Publication Data

US 2011/0022391 A1 Jan. 27, 2011

Related U.S. Application Data

(63) Continuation of application No. PCT/CN2009/070854, filed on Mar. 18, 2009.

(30) Foreign Application Priority Data

Mar. 21, 2008 (CN) ..... 2008 1 0084513

(51) Int. Cl.
*G10L 13/00* (2006.01)

(52) U.S. Cl. ..... 704/264

(58) Field of Classification Search ..... 704/264
See application file for complete search history.

(56) References Cited

U.S. PATENT DOCUMENTS

| | | | | |
|---|---|---|---|---|
| 5,893,056 | A * | 4/1999 | Saikaly et al. | 704/226 |
| 6,078,882 | A | 6/2000 | Sato et al. | |
| 6,636,829 | B1 * | 10/2003 | Benyassine et al. | 704/201 |
| 7,146,309 | B1 * | 12/2006 | Benyassine et al. | 704/201 |

FOREIGN PATENT DOCUMENTS

| | | | |
|---|---|---|---|
| CN | 1470051 | A | 1/2004 |
| CN | 101069231 | A | 11/2007 |
| CN | 101339767 | A | 1/2009 |
| WO | WO 2007027291 | A1 | 3/2007 |

OTHER PUBLICATIONS

"3G TS 26.090—Technical Specification Group Services and System Aspects; Mandatory Speech Codec speech processing functions AMR speech codec; Transcoding functions," Dec. 1999, Version 3.1.0, 3rd Generation Partnership Project, Valbonne, France.

"3GPP TS 26.092—Technical Specification Group Services and System Aspects; Mandatory speech codec speech processing functions; Adaptive Multi-Rate (AMR) speech codec; Comfort noise aspects (Release 6)," Dec. 2004, Version 6.0.0, 3rd Generation Partnership Project, Valbonne, France.

(Continued)

*Primary Examiner* — Jakieda Jackson
(74) *Attorney, Agent, or Firm* — Leydig, Voit & Mayer, Ltd.

(57) ABSTRACT

A method and apparatus for generating an excitation signal for background noise are provided. The method includes: generating a quasi excitation signal by utilizing coding parameters in a speech coding/decoding stage and a transition length of an excitation signal; and obtaining the excitation signal for background noise in a transition stage by generating a weighted sum of the quasi excitation signal and a random excitation signal of a background noise frame. Moreover, the apparatus includes: a quasi excitation signal generation unit and a transition stage excitation signal acquisition unit. Through the synthesizing scheme of comfortable background noise according to the present invention, the transition of a synthesized signal from speech to background noise could be more natural, smooth and continuous, which makes the listeners feel more comfortable.

13 Claims, 1 Drawing Sheet

OTHER PUBLICATIONS

"G.729—Coding of speech at 8kbit/s using conjugate structure algebraic-code-excited linear-prediction (CS-ACELP), Annex B: A silence compression scheme for G.729 optimized for terminals conforming to Recommendation V7.0," Nov. 1996, Series G: Transmission Systems and Media, International Telecommunication Union, Geneva, Switzerland.

"G.729—Coding of speech at 8kbit/s using conjugate structure algebraic-code-excited linear-prediction (CS-ACELP)," Mar. 1996, General Aspects of Digital Transmission Systems, International Telecommunication Union, Geneva, Switzerland.

Extended European Search Report in corresponding European Application No. 09722292.1 (Mar. 3, 2011).

Written Opinion from the International Searching Authority in corresponding PCT Application No. PCT/CN2009/070854 (Jun. 11, 2009).

* cited by examiner

METHOD AND APPARATUS FOR GENERATING AN EXCITATION SIGNAL FOR BACKGROUND NOISE

CROSS-REFERENCE TO RELATED APPLICATIONS

This application is a continuation of International Application No. PCT/CN2009/070854, filed on Mar. 18, 2009, which claims priority to Chinese Patent Application No. 200810084513.X, filed on Mar. 21, 2008, both of which are hereby incorporated by reference in their entireties.

FIELD OF THE INVENTION

The present invention relates to the field of communications, and more particularly, to a method and an apparatus for generating an excitation signal for background noise.

BACKGROUND

In speech communications, speech processing is mainly performed by speech codecs. Since a speech signal has short-time stability, speech codecs generally process the speech signal in frames, each frame being of 10 to 30 ms. All the initial speech codecs have fixed rates, that is, each of the codecs has only one fixed coding rate. For example, the coding rate of a G.729 speech codec is 8 kbit/s, and the coding rate of a G.728 speech codec is 16 kbit/s. As a whole, among these traditional speech codecs with fixed coding rate, the speech codecs with higher coding rate may guarantee coding quality more easily, but occupy more communication channel resources; while the speech codecs with lower coding rate may not guarantee coding quality that easily, but occupy less communication channel resources.

The speech signal includes both a voice signal generated by human speaking and a silent signal generated by gaps in human speaking. The coding rate of the voice signal is referred to as speech (in this case, the speech specifically refers to a signal of human speaking) coding rate, and the coding rate of background noise is referred to as noise coding rate. In speech communications, only the useful voice signal is concerned, while the useless silent signal is not desired to be transmitted, and this decreases transmission bandwidth. However, if merely the voice signal is coded and transmitted and the silent signal is not coded and transmitted, the discontinuity of background noise would occur. Thus a person who is listening at a receiving end will feel rather uncomfortable, and such feeling will be more apparent in the case of stronger background noise so that sometimes the speech would be difficult to understand. In order to solve this problem, the silent signal needs to be coded and transmitted even when no one is speaking Silence compression technology is introduced into speech codecs. In the silence compression technology, the background noise signal is coded with lower coding rate to efficiently decrease communications bandwidth, while the voice signal generated by human speaking is coded with higher coding rate to guarantee communications quality.

At present, an approach for generating an excitation signal for background noise for a G.729B speech codec adds a Discontinuous Transmission System (DTX)/Comfort Noise Generated (CNG) system, i.e., a system for processing background noise, to the prototype of the G.729B speech codec. The system processes 8 kHz-sampled narrowband signals with a frame length of 10 ms for signal processing. According to a CNG algorithm, a level-controllable pseudo white noise is used to excite an interpolated Linear Predictive Coding (LPC) synthesis filter to obtain comfortable background noise, where the level of the excitation signal and the coefficient of the LPC filter are obtained from the previous Silence Insertion Descriptor (SID) frame.

The excitation signal is a pseudo white noise excitation ex(n) which is a mixture of a speech excitation ex1(n) and a Gauss white noise excitation ex2(n). The gain of ex1(n) is relatively small, and ex1(n) is utilized to make the transition from speech to non-speech (such as, noise, etc.) more natural. After the pseudo white noise excitation ex(n) is obtained, ex(n) could be used to excite the synthesis filter to obtain comfortable background noise.

The process for generating the excitation signal is as follows.

Firstly, a target excitation gain $\tilde{G}_t$ is defined as a square root of average energy of current frame excitations. $\tilde{G}_t$ is obtained based on the following smoothing algorithm:

$$\tilde{G}_t = \begin{cases} \tilde{G}_{sid} & \text{if } (Vad_{t-1} = 1) \\ \frac{7}{8}\tilde{G}_{t-1} + \frac{1}{8}\tilde{G}_{sid} & \text{otherwise} \end{cases}$$

where $\tilde{G}_{sid}$, is the gain of a decoded SID frame.

For each of two sub-frames which are formed by dividing 80 sampling points, the excitation signal of a CNG module may be synthesized by:

(1) randomly selecting a pitch lag in a range of [40, 103];

(2) randomly selecting positions and signs of non-zero pulses in fixed codebook vectors of the sub-frames (the structure of the positions and signs of the non-zero pulses is the same as that of the G.729 speech codec); and (3) selecting a self-adaptive codebook excitation signal with a gain, labeling the self-adaptive codebook excitation signal as $e_a(n)$,n=0 . . . 39, labeling a selected fixed codebook excitation signal as $e_f(n)$,n=0 . . . 39, and then calculating a self-adaptive codebook gain $G_a$ and a fixed codebook gain $G_f$ based on the energy of the sub-frames:

$$\frac{1}{40}\sum_{n=0}^{39}(G_a \times e_a(n) + G_f \times e_f(n))^2 = \tilde{G}_t^2$$

where $G_f$ may be selected as a negative value.

It is defined that $$E_a = \left(\sum_{n=0}^{39} e_a(n)^2\right), \quad I = \left(\sum_{n=0}^{119} e_a(n)e_f(n)\right).$$

According to the excitation structure of Algebra Code-Excited Linear Prediction (ACELP), it could be known that $$\sum_{n=0}^{39} e_f(n)^2 = 4.$$

If the self-adaptive codebook gain $G_a$ is fixed, the equation expressing $\tilde{G}_t$ will become a second order equation related to $G_f$:

$$G_f^2 + \frac{G_a \times I}{2} G_f + \frac{E_a \times G_a^2 - K}{4} = 0$$

The value of $G_a$ may be defined to ensure that the above equation has solutions. Further, the application of some self-adaptive codebook gains with large values may be restricted. Thus, the self-adaptive codebook gain $G_a$ may be randomly selected in the following range:

$$\left[0, \text{Max}\left\{0.5, \sqrt{\frac{K}{A}}\right\}\right], \text{ with } A = E_a - I^2/4$$

where the root with the smallest absolute value among the roots of the equation of $$\frac{1}{40}\sum_{n=0}^{39}(G_a \times e_a(n) + G_f \times e_f(n))^2 = \tilde{G}_t^2$$

is used as the value of $G_f$.

Finally, the excitation signal for the G.729 speech codec may be constructed with the following equation:

$$ex_1(n)=G_a \times e_a(n)+G_f \times e_f[n], n=0 \ldots 39$$

The excitation ex(n) may be synthesized in the following manner.

It is assumed that $E_1$ is the energy of $ex_1(n)$, $E_2$ is the energy of $ex_2(n)$, and $E_3$ is a dot product of $ex_1(n)$ and $ex_2(n)$:

$$E_1=\Sigma ex_1^2(n)$$

$$E_2=\Sigma ex_2^2(n)$$

$$E_3=\Sigma ex_1(n) \cdot ex_2(n)$$

where the calculated number of dots exceeds the value of themselves.

It is assumed that $\alpha$ and $\beta$ are proportional coefficients of $ex_1(n)$ and $ex_2(n)$ in a mixed excitation respectively, where $\alpha$ is set to 0.6 and $\beta$ is determined based on the following quadratic equation:

$$\beta^2 E_2+2\alpha\beta E_3+(\alpha^2-1)E_1=0, \text{ with } \beta>0.$$

If there is no solution for $\beta$, $\beta$ will be set to 0 and $\alpha$ will be set to 1. The final excitation ex(n) for the CNG module becomes:

$$ex(n)=\alpha ex_1(n)+\beta ex_2(n)$$

The above discussion illustrates the principle of generating an excitation signal for background noise for the CNG module of the G.729B speech codec.

According to the implementation process described above, certain speech excitation ex1(n) may be added when generating an excitation signal for background noise for the G.729B speech codec. However, the speech excitation ex1(n) is just added formally, but actual contents, such as lags of the self-adaptive codebook and positions and signs of the fixed codebook, are all generated randomly, resulting in a strong randomness. Therefore, the correlation between the excitation signal for background noise and the excitation signal for the previous speech frame is poor, so that the transition from a synthesized speech signal to a synthesized background noise signal is unnatural, which makes the listeners feel uncomfortable.

SUMMARY

In order to solve the technology problem described above, an embodiment of the present invention provides a method for generating an excitation signal for background noise including: generating a quasi excitation signal by utilizing coding parameters in a speech coding/decoding stage and a transition length of an excitation signal; and obtaining the excitation signal for background noise in a transition stage by generating a weighted sum of the quasi excitation signal and a random excitation signal of a background noise frame.

Accordingly, an embodiment of the present invention further provides an apparatus for generating an excitation signal for background noise including:

- a quasi excitation signal generation unit, configured to generate a quasi excitation signal by utilizing coding parameters in a speech coding/decoding stage and a transition length of an excitation signal; and
- a transition stage excitation signal acquisition unit, configured to obtain the excitation signal for background noise in a transition stage by generating a weighted sum of the quasi excitation signal generated by the quasi excitation signal generation unit and a random excitation signal of a background noise frame.

In the embodiments of the present invention, the excitation signal for background noise in the transition stage is obtained by generating the weighted sum of the generated quasi excitation signal and the random excitation signal for background noise in the transition stage during which the signal frame is converted from the speech frame to the background noise frame, and the background noise is synthesized by replacing the random excitation signal with the excitation signal in the transition stage. Since information in the two kinds of excitation signals is included in the transition stage, through this synthesizing scheme of comfortable background noise, the transition of a synthesized signal from speech to background noise could be more natural, smooth and continuous, which makes the listeners feel more comfortable.

DETAILED DESCRIPTION

Some preferred exemplary embodiments of the present invention are described in detail below in conjunction with the accompany drawings.

In the embodiments of the present invention, a process for generating an excitation signal for background noise includes: utilizing an excitation signal of a speech frame, a pitch lag and a random excitation signal of a background noise frame in a transition stage during which a signal frame is converted from the speech frame to the background noise frame. That is, in the transition stage, a quasi excitation signal to be weighted is generated by utilizing the excitation signal of the previous speech frame and the pitch lag of the last sub-frame, and then the excitation signal for background noise in the transition stage is obtained by generating a weighted sum of the quasi excitation signal and the random excitation signal for background noise point by point (i.e., by increasing or decreasing progressively; however, it is not limited to this manner). The specific implementation process will be discussed in connection with the following Figures and embodiments.

Figure 1:
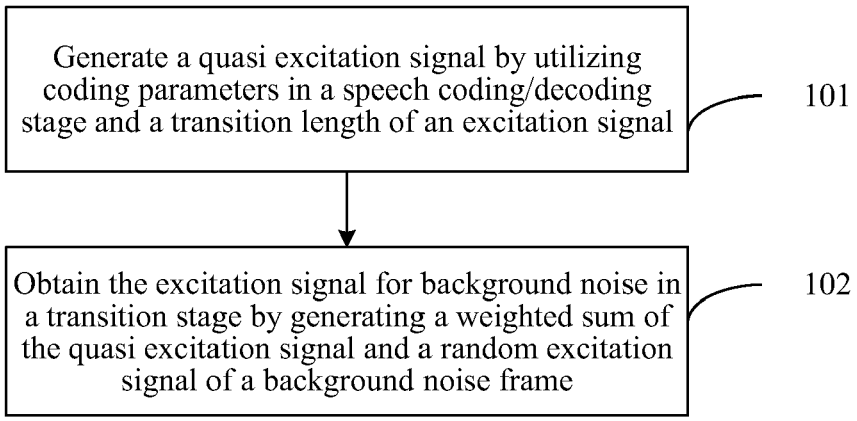
FIG. 1 is a flowchart of a method for generating an excitation signal for background noise according to an embodiment of the present invention.

Referring to FIG. 1, it is a flowchart of a method for generating excitation signal for background noise according to an embodiment of the present invention. The method includes the following steps.

Step 101: A quasi excitation signal is generated by utilizing coding parameters in a speech coding/decoding stage and a transition length of an excitation signal.

Step 102: The excitation signal for background noise in a transition stage is obtained by generating a weighted sum of the quasi excitation signal and a random excitation signal of a background noise frame.

Preferably, before step 101, the method further includes setting the transition length N of the excitation signal when a signal frame is converted from a speech frame to the background noise frame.

Alternatively, a speech codec pre-stores the coding parameters of the speech frame, where the coding parameters include an excitation signal and a pitch lag which is also referred to as self-adaptive codebook lag.

That is, the received coding parameters of each speech frame, which include the excitation signal and the pitch lag, are stored in the speech codec. The excitation signal is stored in real time in an excitation signal storage old old_exc(i) where $i \in [0, T-1]$ and T is the maximum value of the pitch lag Pitch set by the speech codec. If the value of T exceeds a frame length, the last several frames will be stored in the excitation signal storage old_exc(i) For example, if the value of T is the length of two frames, the last two frames will be stored in the excitation signal storage old_exc(i). In other words, the size of the excitation signal storage old_exc(i) is determined by the value of T. In addition, the excitation signal storage old_exc(i) and the pitch lag Pitch are updated in real time, and each frame is required to be updated. Actually, since each frame contains a plurality of sub-frames, Pitch is the pitch lag of the last sub-frame.

The transition length N of the excitation signal is set when the signal frame is converted from the speech frame to the background noise frame. In general, the value of the transition length N is set according to practical requirements. For example, the value of N is set to 160 in this embodiment of the present invention. However, N is not limited to this value.

Then step 101 is performed, where the quasi excitation signal pre_exc(n) is generated by utilizing the coding parameters in the speech coding/decoding stage and the transition length of the excitation signal based on the following equation:

$$\text{pre_exc}(n)=\text{old_exc}(T-\text{Pitch}+n\ \%\ \text{Pitch})$$

where n is a data sampling point of the signal frame which satisfies $n \in [0, N-1]$, n % Pitch represents a remainder obtained by dividing n by Pitch, T is the maximum value of the pitch lag, Pitch is the pitch lag of the last sub-frame in the previous superframe, and N is the transition length of the excitation signal.

In step 102, the excitation signal cur_exc(n) for background noise in the transition stage is obtained by generating the weighted sum of the quasi excitation signal and the random excitation signal of the background noise frame.

That is, if the excitation signal in the transition stage is assumed as cur_exc(n), cur_exc(n) may be represented as:

$$\text{cur_exc}(n)=a(n)\text{pre_exc}(n)+\beta(n)\text{random_exc}(n)$$

where random_exc(n) is an excitation signal generated randomly, n is a sampling point of the signal frame, a(n) and β(n) are weighting factors of the quasi excitation signal and the random excitation signal. In addition, a(n) decreases with the increasing of the value of n and β(n) increases with the increasing of the value of n, where the sum of a(n) and β(n) is 1.

Preferably, the weighting factor a(n) is calculated based on the equation $a(n)=1-n/N$, and the weighting factor β(n) is calculated based on the equation $\beta(n)=n/N$, where n is a data sampling point of the signal frame which satisfies $n \in [0, N-1]$, and N is the transition length of the excitation signal. In general, the value of N is preferably set to 160.

An exemplary approach for generating the weighted sum according to the embodiment of the present invention is to generate the weighted sum point by point, which, however, is not limited to this. Other approaches for generating the weighted sum, such as, generating an even-point weighted sum, an odd-point weighed sum, etc., may also be used. Specific implementation processes for the other approaches are similar to that for generating the weighted sum point by point, and thus will not be described any more.

Preferably, after the excitation signal cur_exc(n) in the transition stage is obtained, the method may further include obtaining a final background noise signal by utilizing the excitation signal cur_exc(n) in the transition stage to excite an LPC synthesis filter.

It would be appreciated from the above technical solution that, in the embodiment of the present invention, the excitation signal of the speech frame is introduced in the transition stage so that the transition of the signal frame from speech to background noise becomes more natural and continuous, which makes the listeners feel more comfortable.

Specific embodiments of the present invention are described below so as to facilitate those skilled in the art to understand the present invention.

The first embodiment is an implementation process for applying the present invention to a G.729B CNG. It should be noted that, in a G.729B speech codec, the maximum value of pitch lag T is 143. The implementation process is described in detail below.

(1) A speech codec receives each speech frame and stores coding parameters of the speech frames. The coding parameters include an excitation signal and a pitch lag Pitch of the last sub-frame. The excitation signal may be stored in real time in an excitation signal storage old_exc(i), where $i \in [0, 142]$. Since the frame length of the G.729B speech codec is 80, the excitation signal of the last two frames is buffered in the excitation signal storage old_exc(i). Of course, the last frame, a plurality of frames or less than one frame may be buffered in the excitation signal storage old_exc(i) according to actual situations.

(2) The transition length N of the excitation signal is set when a signal frame is converted from the speech frame to a background noise frame, where N=160. Since in the G.729B speech codec, the length of each frame is 10 ms and there are 80 data sampling points, the transition length is set to two 10 ms frames.

(3) A quasi excitation signal pre_exc(n) of the speech frame is generated according to the excitation signal storage old_exc(i) based on the following equation:

$$\text{pre_exc}(n)=\text{old_exc}(T-\text{Pitch}+n\ \%\ \text{Pitch})$$

where n is a data sampling point of the signal frame which satisfies n∈[0,159], n % Pitch represents a remainder obtained by dividing n by Pitch, T is the maximum value of the pitch lag, and Pitch is the pitch lag of the last sub-frame in the previous superframe.

(4) The excitation signal in a transition stage is assumed as cur_exc(n). The excitation signal cur_exc(n) in the transition stage is obtained by generating a weighted sum of the quasi excitation signal and a random excitation signal of the background noise frame based on the following equation:

$$\text{cur_exc}(n)=a(n)\text{pre_exc}(n)+\beta(n)\text{ex}(n)$$

where ex(n) is pseudo white noise excitation, i.e., an excitation signal. The excitation signal is a mixture of a speech excitation ex1(n) and a Gauss white noise excitation ex2(n). The gain of ex1(n) is relatively small, and ex1(n) is used to make the transition between speech and non-speech more natural. The specific process for generating ex1(n) has been described in the BACKGROUND section and thus will not be described any more.

a(n) and β(n) are weighting factors of the two excitation signals. In addition, a(n) decreases with the increasing of the value of n and β(n) increases with the increasing of the value of n, where the sum of a(n) and β(n) is 1. a(n) and β(n) are represented respectively as:

$$a(n)=1-n/160$$

$$\beta(n)=n/160$$

(5) A final background noise signal could be obtained by utilizing the excitation signal cur_exc(n) in the transition stage to excite an LPC synthesis filter.

Thus, in the G.729B speech codec, the embodiment of the present invention introduces the quasi excitation signal into the transition stage during which the signal frame is converted from speech to background noise, so that the transition of the signal frame from speech to background noise becomes more natural and continuous, which makes the listeners feel more comfortable.

The second embodiment is an implementation process for applying the present invention to an Adaptive Multi-rate Codec (AMR) CNG. It should be noted that, in the AMR, the maximum value of pitch lag T is 143. The specific implementation process is described in detail below.

(1) A speech codec receives each speech frame and stores coding parameters of the speech frames. The coding parameters include an excitation signal and a pitch lag Pitch of the last sub-frame. The excitation signal is stored in real time in an excitation signal storage old_exc(i), where i∈[0,142]. Since the frame length of the AMR is 160, only the excitation signal of the last frame is buffered in the excitation signal storage old_exc(i). Of course, the last frame, a plurality of frames or less than one frame may be buffered in the excitation signal storage old_exc(i) according to actual situations (2) The transition length N of the excitation signal is set when a signal frame is converted from the speech frame to a background noise frame, where N=160. Since in the AMR, the length of each frame is 20 ms and there are 80 data sampling points, the transition length is set to one 10 ms frame.

(3) A quasi excitation signal pre_exc(n) of the speech frame is generated according to the excitation signal storage old_exc(i) based on the following equation:

$$\text{pre_exc}(n)=\text{old_exc}(T-\text{Pitch}+n\ \%\ \text{Pitch})$$

where n is a data sampling point of the signal frame which satisfies n∈[0,159], n % Pitch represents a remainder obtained by dividing n by Pitch, T is the maximum value of the pitch lag, and Pitch is the pitch lag of the last sub-frame in the previous superframe.

(4) The excitation signal in a transition stage is assumed as cur_exc(n). The excitation signal cur_exc(n) in the transition stage is obtained by generating a weighted sum of the quasi excitation signal and a random excitation signal of the background noise frame based on the following equation:

$$\text{cur_exc}(n)=a(n)\text{pre_exc}(n)+\beta(n)\text{ex}(n)$$

where ex(n) is fixed codebook excitation (with a final gain). Comfortable background noise is obtained by utilizing a gain-controllable random noise to excite an interpolated LPC synthesis filter. That is, for each sub-frame, positions and signs of non-zero pulses in the fixed codebook excitation are generated by utilizing uniformly-distributed pseudo random numbers. The values of the excitation pulses are +1 and −1. The process for generating the fixed codebook excitation is well known to those skilled in the art and thus will not be described any more.

a(n) and β(n) are weighting factors of the two excitation signals. In addition, a(n) decreases with the increasing of the value of n and β(n) increases with the increasing of the value of n, where the sum of a(n) and β(n) is 1. a(n) and β(n) are represented respectively as:

$$a(n)=1-n/160$$

$$\beta(n)=n/160$$

(5) A final background noise signal could be obtained by utilizing the excitation signal cur_exc(n) in the transition stage to excite the LPC synthesis filter.

Thus, in the CNG algorithm of the AMR, similar to the G.729B speech codec, the embodiment of the present invention introduces the quasi excitation signal into the transition stage during which the signal frame is converted from speech to background noise so as to obtain the excitation signal in the transition stage, so that the transition of the signal frame from speech to background noise becomes more natural and continuous, which makes the listeners feel more comfortable.

The third embodiment is an implementation process for applying the present invention to a G.729.1 CNG.

G.729.1 speech codec is a speech codec promulgated recently by the International Telecommunication Union (ITU), which is a broadband speech codec, i.e., the speech signal bandwidth to be processed is 50~7000 Hz. When processed, an input signal is divided into a high frequency band (4000~7000 Hz) and a low frequency band (50~4000 Hz) to be processed respectively. The low frequency band utilizes a CELP model, which is a basic model for speech processing and used by codecs, such as G.729 speech codec, AMR, etc. The basic frame length for signal processing of the G.729.1 speech codec is 20 ms, and the frame for signal processing is referred to as superframe. Each superframe has 320 signal sampling points. After dividing the frequency bands, there are 160 signal sampling points for each frequency band in the superframe. In addition, the G.729.1 speech codec also defines a CNG system for processing noise, where an input signal is also divided into a high frequency band and a low frequency band to be processed respectively. The low frequency band also utilizes a CELP model. The embodiment of the present invention may be applied to the processing procedure in the low frequency band in the G.729.1 CNG system, and the implementation process of applying the embodiment of the present invention to a G.729.1 CNG model is described in detail below.

(1) A speech codec receives each speech coding superframe and stores coding parameters of the speech coding superframes. The coding parameters include an excitation signal and a pitch lag Pitch of the last sub-frame. The excitation signal may be stored in real time in an excitation signal storage old_exc(i), where i∈[0,142], since the maximum value of the pitch lag T is 143

(2) A transition length N of the excitation signal is set when a signal frame is converted from the speech coding superframe to a background noise coding superframe, where N=160. That is, the transition stage is a superframe.

(3) A quasi excitation signal pre_exc(n) of the speech coding superframe is generated according to the excitation signal storage old_exc(i) based on the following equation:

$$\text{pre_exc}(n)=\text{old_exc}(T-\text{Pitch}+n\ \%\ \text{Pitch})$$

where n is a data sampling point of the signal frame which satisfies n∈[0,159], n % Pitch represents a remainder obtained by dividing n by Pitch, T is the maximum value of the pitch lag, and Pitch is the pitch lag of the last sub-frame in the previous superframe.

(4) The excitation signal in a transition stage is assumed as cur_exc(n). The excitation signal cur_exc(n) for background noise in the transition stage is obtained by generating a weighted sum of the quasi excitation signal and a random excitation signal of the background noise coding superframe point by point based on the following equation:

$$\text{cur_exc}(n)=a(n)\text{pre_exc}(n)+\beta(n)\text{ex}(n)$$

where n∈[0,159] and ex(n) is the currently-calculated excitation signal for background noise.

a(n) and β(n) are weighting factors of the two excitation signals. In addition, a(n) decreases with the increasing of the value of n and β(n) increases with the increasing of the value of n, where the sum of a(n) and β(n) is 1. a(n) and β(n) are represented respectively as:

$$a(n)=1-n/160$$

$$\beta(n)=n/160$$

(5) A final background noise signal could be obtained by utilizing the excitation signal cur_exc(n) in the transition stage to excite an LPC synthesis filter.

Thus, in the G.729.1 speech codec, the excitation signal in the transition stage could be obtained after the quasi excitation signal is introduced into the transition stage during which the signal frame is converted from speech to background noise, so that the transition of the signal frame from speech to background noise becomes more natural and continuous, which makes the listeners feel more comfortable.

Figure 2:
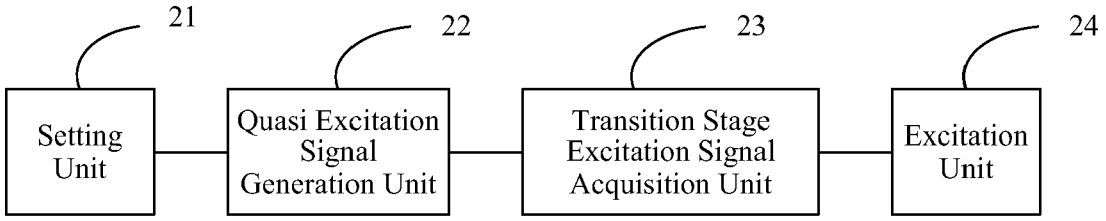
FIG. 2 is a schematic structure diagram of an apparatus for generating an excitation signal for background noise according to an embodiment of the present invention.

In addition, an embodiment of the present invention provides an apparatus for generating an excitation signal for background noise. The schematic structure diagram of the apparatus is shown in FIG. 2. The apparatus includes a quasi excitation signal generation unit 22 and a transition stage excitation signal acquisition unit 23. Preferably, the apparatus may further include a setting unit 21.

The setting unit 21 is configured to set a transition length N of an excitation signal when a signal frame is converted from a speech frame to a background noise frame.

The quasi excitation signal generation unit 22 is configured to generate a quasi excitation signal pre_exc(n) of the speech frame based on the transition length N set by the setting unit 21. The quasi excitation signal pre_exc(n) is calculated base on the following equation:

$$\text{pre_exc}(n)=\text{old_exc}(T-\text{Pitch}+n\ \%\ \text{Pitch})$$

where n is a data sampling point of the signal frame which satisfies n∈[0, N−1], n % Pitch represents a remainder obtained by dividing n by Pitch, T is the maximum value of the pitch lag, and Pitch is the pitch lag of the last sub-frame in the previous superframe.

The transition stage excitation signal acquisition unit 23 is configured to obtain an excitation signal cur_exc(n) for background noise in the transition stage by generating the weighted sum of the quasi excitation signal and a random excitation signal of a background noise frame. The excitation signal cur_exc(n) for background noise in the transition stage may be calculated base on the following equation:

$$\text{cur_exc}(n)=a(n)\text{pre_exc}(n)+\beta(n)\text{random_exc}(n)$$

where random_exc(n) is an excitation signal generated randomly, and a(n) and β(n) are weighting factors of the two excitation signals. In addition, a(n) decreases with the increasing of the value of n and β(n) increases with the increasing of the value of n, where the sum of a(n) and β(n) is 1.

a(n) and β(n) are represented respectively as:

$$a(n)=1-n/160$$

$$\beta(n)=n/160$$

Preferably, the apparatus may further include an excitation unit 24, which is configured to obtain a background noise signal by utilizing the excitation signal obtained by the transition stage excitation signal acquisition unit 23 to excite a synthesis filter.

Preferably, a storage unit is configured to pre-store coding parameters of the speech frame, which include the excitation signal and the pitch lag.

Preferably, the apparatus for generating an excitation signal for background noise may be integrated into an encoding end or a decoding end, or exist independently. For example, the apparatus may be integrated into a DTX in the encoding end, or a CNG in the decoding end.

The functions and effects of the various units in the apparatus have been described in detail with respect to the implementation process of corresponding steps in the methods described above, and thus will not be described any more.

The excitation signal in the transition stage is obtained by generating the weighted sum of the generated quasi excitation signal and the random excitation signal for background noise in the transition stage during which the signal frame is converted from the speech frame to the background noise frame, and the background noise is synthesized by replacing the random excitation signal with the excitation signal in the transition stage. Since information in the two kinds of excitation signals is included in the transition stage, through this synthesizing scheme of comfortable background noise, the transition of a synthesized signal from speech to background noise could be more natural, smooth and continuous, thereby sounding more comfortable.

It should be appreciated for those skilled in the art that all or part of the steps of the methods in the above embodiments may be implemented by related hardware instructed by program. The program may be stored in a computer-readable storage medium. When executed, the program may be used to: generate a quasi excitation signal by utilizing coding parameters in a speech coding/decoding stage and a transition length of an excitation signal; and obtain the excitation signal in a transition stage by generating a weighted sum of the quasi excitation signal and a random excitation signal of a background noise frame. The above mentioned storage medium may be a read-only memory, a magnetic disk or an optical disc.

The above disclosure is only the some exemplary embodiments of the present invention. It should be noted that, for those skilled in the art, various modifications and variations may be made to the present invention without departing from the principle of the present invention. These modifications and variations should be regarded as falling within the protection scope of the present invention.

What is claimed is:

1. A method for generating an excitation signal for background noise, comprising:

generating a quasi excitation signal of a speech frame by utilizing an excitation signal and a pitch lag in a speech coding and/or decoding stage and a transition length of the excitation signal; and obtaining the excitation signal for background noise in a transition stage by generating a weighted sum of the quasi excitation signal and a random excitation signal of a background noise frame based on the following equation:

$$\text{cur_exc}(n)=a(n)\text{pre_exc}(n)+\beta(n)\text{random_exc}(n)$$

where cur _exc(n) is the excitation signal for background noise in the transition stage, pre_exc(n) is the quasi excitation signal of the speech frame, random_exc(n) is the random excitation signal, a(n) and β(n) are weighting factors of the quasi excitation signal and the random excitation signal respectively, and n is a sampling point of a signal frame.

2. The method for generating an excitation signal for background noise according to claim 1, further comprising:

setting the transition length of the excitation signal when the signal frame is converted from the speech frame to the background noise frame.

3. The method for generating an excitation signal for background noise according to claim 2, wherein the excitation signal in the coding parameters is stored in real time in an excitation signal storage old_exc(i), where i∈[0,T] and T is a maximum value of the pitch lag set by a speech codec.

4. The method for generating an excitation signal for background noise according to claim 3, wherein a size of the excitation signal storage old_exc(i) is determined by the value of T.

5. The method for generating an excitation signal for background noise according to claim 2, wherein generating the quasi excitation signal comprises:

generating the quasi excitation signal of the speech frame by utilizing the excitation signal and the pitch lag of a last sub-frame contained in the coding parameters and the transition length of the excitation signal.

6. The method for generating an excitation signal for background noise according to claim 5, wherein the quasi excitation signal of the speech frame is generated based on the following equation:

$$\text{pre_exc}(n)=\text{old_exc}(T-\text{Pitch}+n\%\text{Pitch})$$

where n is a data sampling point of the signal frame which satisfies n∈[0,N−1], n% Pitch represents a remainder obtained by dividing n by Pitch , T a maximum value of the pitch lag, Pitch is the pitch lag of the last sub-frame in a previous superframe, and N is the transition length of the excitation signal.

7. The method for generating an excitation signal for background noise according to claim 6, wherein a(n) decreases with increasing of the value of n, and β(n) increases with increasing of the value of n, and the sum of a(n) and ϵ(n) is 1.

8. The method for generating an excitation signal for background noise according to claim 7, wherein the weighting factor a(n) is calculated based on an equation a(n)=1−n/N; and the weighting factor β(n) is calculated based on an equation βn)=n/N, where n is a sampling point of the signal frame which satisfies n∈[0,N−1], and N is the transition length of the excitation signal.

9. The method for generating an excitation signal for background noise according to claim 1, further comprising:

obtaining a background noise signal by utilizing the excitation signal cur_exc(n) for background noise in the transition stage to excite a synthesis filter.

10. An apparatus for generating an excitation signal for background noise, comprising:

a quasi excitation signal generation unit, configured to generate a quasi excitation signal by utilizing an excitation signal and a pitch lag in a speech coding and/or decoding stage and a transition length of the excitation signal; and a transition stage excitation signal acquisition unit, configured to obtain the excitation signal for background noise in a transition stage by generating a weighted sum of the quasi excitation signal and a random excitation signal of a background noise frame based on the following equation:

$$\text{cur_exc}(n)=a(n)\text{pre_exc}(n)+\beta(n)\text{random_exc}(n)$$

where cur_exc(n) is the excitation signal for background noise in the transition stage, pre_exc(n) is the quasi excitation signal of the speech frame, random_exc(n) is the random excitation signal, a(n) and β(n) are weighting factors of the quasi excitation signal and the random excitation signal respectively, and n is a sampling point of a signal frame.

11. The apparatus for generating an excitation signal for background noise according to claim 10, further comprising:

a setting unit, configured to set the transition length of the excitation signal when the signal frame is converted from the speech frame to the background noise frame.

12. The apparatus for generating an excitation signal for background noise according to claim 11, further comprising:

an excitation unit, configured to obtain a background noise signal by utilizing the excitation signal obtained by the transition stage excitation signal acquisition unit to excite a synthesis filter.

13. The apparatus for generating an excitation signal for background noise according to claim 10, wherein the apparatus for generating excitation signal for background noise is integrated into an encoding end or a decoding end, or exists independently.

* * * * *

UNITED STATES PATENT AND TRADEMARK OFFICE

CERTIFICATE OF CORRECTION

PATENT NO. : 8,370,154 B2
APPLICATION NO. : 12/887066
DATED : February 5, 2013
INVENTOR(S) : Dai et al.

It is certified that error appears in the above-identified patent and that said Letters Patent is hereby corrected as shown below:

In the Claims

Column 12, line 4, "$\epsilon(n)$ is 1." should read -- $\beta(n)$ is 1. --.

Column 12, line 10, "$\beta n)=n/N$" should read -- $\beta(n)=n/N$ --.

Signed and Sealed this
Seventh Day of May, 2013

Teresa Stanek Rea
*Acting Director of the United States Patent and Trademark Office*